US006571134B1

(12) United States Patent
Gramckow et al.

(10) Patent No.: US 6,571,134 B1
(45) Date of Patent: May 27, 2003

(54) METHOD AND DEVICE FOR DETERMINING AN INTERMEDIARY PROFILE OF A METAL STRIP

(75) Inventors: Otto Gramckow, Uttenreuth (DE); Peter Protzel, Flöha (DE); Lars Kindermann, Erlangen (DE); Friedemann Schmid, Erlangen (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/622,512

(22) PCT Filed: Feb. 8, 1999

(86) PCT No.: PCT/DE99/00336

§ 371 (c)(1),
(2), (4) Date: Oct. 19, 2000

(87) PCT Pub. No.: WO99/42232

PCT Pub. Date: Aug. 26, 1999

(30) Foreign Application Priority Data

Feb. 18, 1998 (DE) ..... 198 06 811

(51) Int. Cl.[7] ..... G05B 13/02

(52) U.S. Cl. ..... 700/29; 700/30; 700/31; 700/128; 700/129; 700/173; 706/12; 706/14; 706/15; 72/11.7; 72/9.5; 72/14.1

(58) Field of Search ..... 700/28, 29, 30, 700/31, 128, 129, 173, 204; 72/9.1, 9.2, 11.7, 229–234, 365.2, 14.1, 201; 706/14, 15, 12, 10

(56) References Cited

U.S. PATENT DOCUMENTS 4,599,883 A * 7/1986 Ginzburg et al. ..... 72/234
5,341,664 A * 8/1994 Noe et al. ..... 72/161
5,513,097 A * 4/1996 Gramckow et al. ..... 700/48
5,673,368 A * 9/1997 Broese et al. ..... 706/23
5,855,131 A * 1/1999 Schmid et al. ..... 72/11.7
6,263,716 B1 * 7/2001 Kaplan ..... 72/229
6,473,658 B1 * 10/2002 Brose et al. ..... 700/31

FOREIGN PATENT DOCUMENTS

| | | |
|---|---|---|
| DE | 43 38 615 | 5/1995 |
| DE | 196 25 442 | 1/1998 |
| DE | 196 42 918 | 4/1998 |
| DE | 196 42 919 | 4/1998 |
| DE | 196 42 921 | 4/1998 |

OTHER PUBLICATIONS

Martinetz et al., "Neuronale Netze zur Steuerung von Walzstrassen", Automatisierungstechnische Praxis, vol. 38, No. 10, Oct. 1,1996*.

"High Accuracy and Rapid–Response Hot Strip Mill", Techno Japan, vol. 20, No. 9, Sep. 1987*.

Kenzo Toda et al., "Development of High–Accuracy and Rapid–Response Production Technology at Large–Scale Hot Strip Mill", Research and Development in Japan Awarded the Okochi Memorial Prize 1987*.

* cited by examiner

*Primary Examiner*—Ramesh Patel
(74) *Attorney, Agent, or Firm*—Kenyon & Kenyon

(57) ABSTRACT

Method for determining an intermediary profile of a metal strip between an upstream and a downstream roll stand in a mill train having at least two roll stands is described intermediary profile ($p_{out}$) and the final profile ($p_{out}$) of the metal strip downstream from the downstream roll stand are determined using an analytical model with parameters. The final profile is determined using a final profile model. At least one parameter is modified so that the difference between the final profile, determined using an analytical model, and the final profile, determined using the final profile model, is reduced.

13 Claims, 2 Drawing Sheets

METHOD AND DEVICE FOR DETERMINING AN INTERMEDIARY PROFILE OF A METAL STRIP

FIELD OF INVENTION

The present invention relates to a method and a device for determining an intermediary profile of a metal strip between an upstream and a downstream roll stand in a mill train.

BACKGROUND INFORMATION

In steel and aluminum manufacturing, optimization of the rolling process has a significant role both regarding the possible quality improvements and regarding cost reduction potential.

One important function of the process control of a mill train is determining the setting of the system for the next metal strip as accurately as possible before the strip enters the mill train. The process control is based on a series of models, which should describe the technological process taking place in the mill train as accurately as possible. This description is made difficult by the complexity of the process, which is affected by many non-linear influences and by changes in the process conditions over time.

The profile of the metal strip is an important quality criterion for its geometry after leaving the mill train. In the simplest case the profile is defined as the difference in thickness between the center and the edges of a metal strip. During the entire rolling process the profile of the strip entering a roll stand changes from one roll stand to the other. Since measuring the profile of the metal strip is complicated and costly, it is usually not measured until the end of the mill train and compared to the prediction of the model. Conventionally, in order to determine the profile ($p_1$) of a metal strip downstream from the individual roll stands and thus ultimately the final profile, the following equation has been used repeatedly $$p_i = k_i \cdot p_{i-1} \cdot \frac{h_i}{h_{i-1}} + (1 - k_i)\Pi_i \tag{1}$$

In this equation $k_i$ is calculated according to the article "High Accuracy and Rapid-Response Hot Strip Mill," TECHNO Japan Vol. 20, No. 9, September 1987, pp. 54–59 using the formula $$k_i = \frac{1}{\pi}\arctan\left(\frac{c_{i1} - \ln x_i}{c_{i2}}\right) + \frac{1}{2} \tag{2}$$

where $$x_i = \frac{\sqrt{D_i \cdot h_i^{1.5}}}{b^2}. \tag{3}$$

In addition,

| | |
|---|---|
| $p_{i-1}$ | profile of the metal strip upstream from the roll stand |
| $h_{i-1}$ | thickness of the metal strip upstream from the roll stand |

-continued

| | |
|---|---|
| $h_i$ | thickness of the metal strip downstream from the roll stand |
| $\Pi_i$ | work roll gap profile |
| $D_i$ | work roll diameter |
| b | width of the metal strip |
| $C_{i1}$, $C_{i2}$ | model parameters |

The disadvantage here is that the equations for determining $k_i$ and $x_i$ apply only approximately. In addition, model parameters $c_{i1}$ and $c_{i2}$ are unknown and must be determined experimentally. This often results in insufficient determination of the final thickness profile.

This fact leads to the use of additional heuristic models. Experiments with adaptive neural networks have shown that these are capable of predicting the final profile in one step considerably more accurately than analytical models. Thus German Patent Application 196 42 918 describes a system for calculating the final profile of the metal strip, where selected parameters are determined using information processing based on neural networks.

SUMMARY

An object of the present invention is to provide a method for determining intermediary profiles and a final profile of a metal strip in a mill train, according to which the intermediary profiles are determined more accurately than by conventional methods.

This object is achieved by providing a method and a device, where

- at least one intermediary profile of a metal strip to be rolled is determined downstream from a roll stand and the final profile of this metal strip is determined after passing through all roll stands, using an analytical model for at least one roll stand;
- this final profile is determined using a,second model, and
- at least one parameter of the analytical model is modified so that the analytical model delivers a value for the final profile which coincides with the value obtained using the second model with a predefinable degree of accuracy.

The intermediary profiles are determined using an analytical model. In particular, an existing mathematical model of the process can be used whose parameters are optimized for each prediction. This expanded use of conventional models for a mill train considerably reduces the cost of the method according to the present invention and allows an existing mill train or roll stand to be retrofitted.

The second model is preferably a neural network in which non-linearities of the process can also be modeled. In particular, it is not used for optimizing the parameters of the analytical model until, after sufficient training, it delivers considerably better values for the final profile than the analytical model.

BRIEF DESCRIPTION OF THE DRAWINGS

Advantageous refinements of the method result from the subclaims and the description that follows of an embodiment with reference to the drawings.

DETAILED DESCRIPTION

Figure 1:
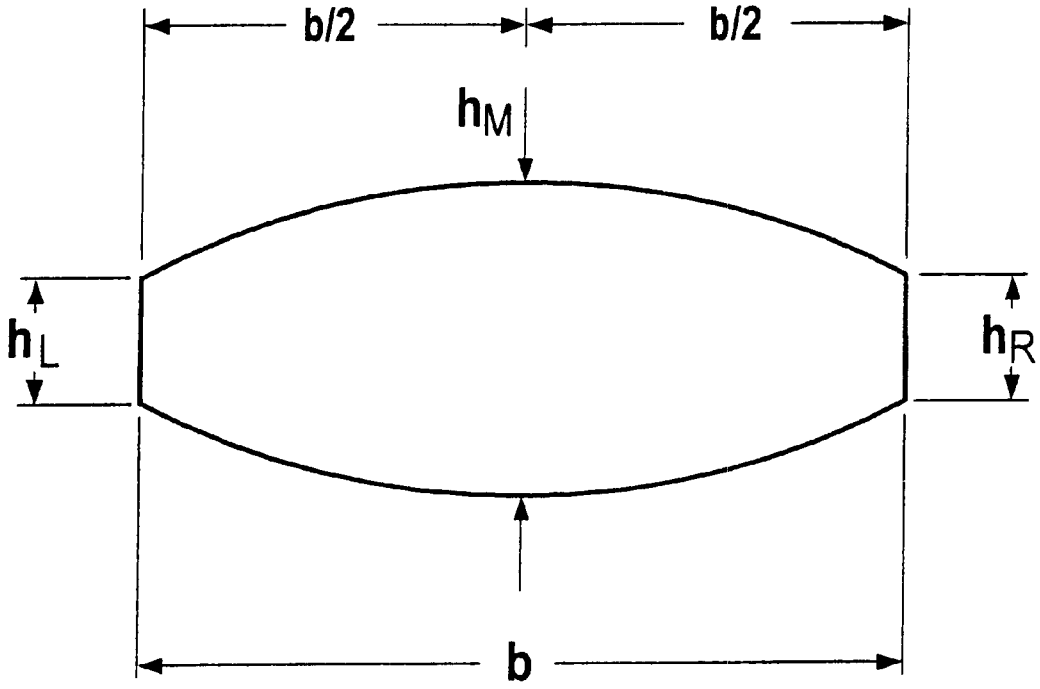
FIG. 1 shows the cross-section of a metal strip.

FIG. 1 shows the cross-section of a metal strip, where b is the strip width, $h_M$ is the strip thickness in the center of the metal strip, $h_L$ is the strip thickness at the left edge of the metal strip, and $h_R$ is the strip thickness at the right edge of the metal strip. One possible definition of profile p of the metal strip is the function $$p = h_M = \frac{h_L + h_R}{2} \tag{4}$$

Figure 2:
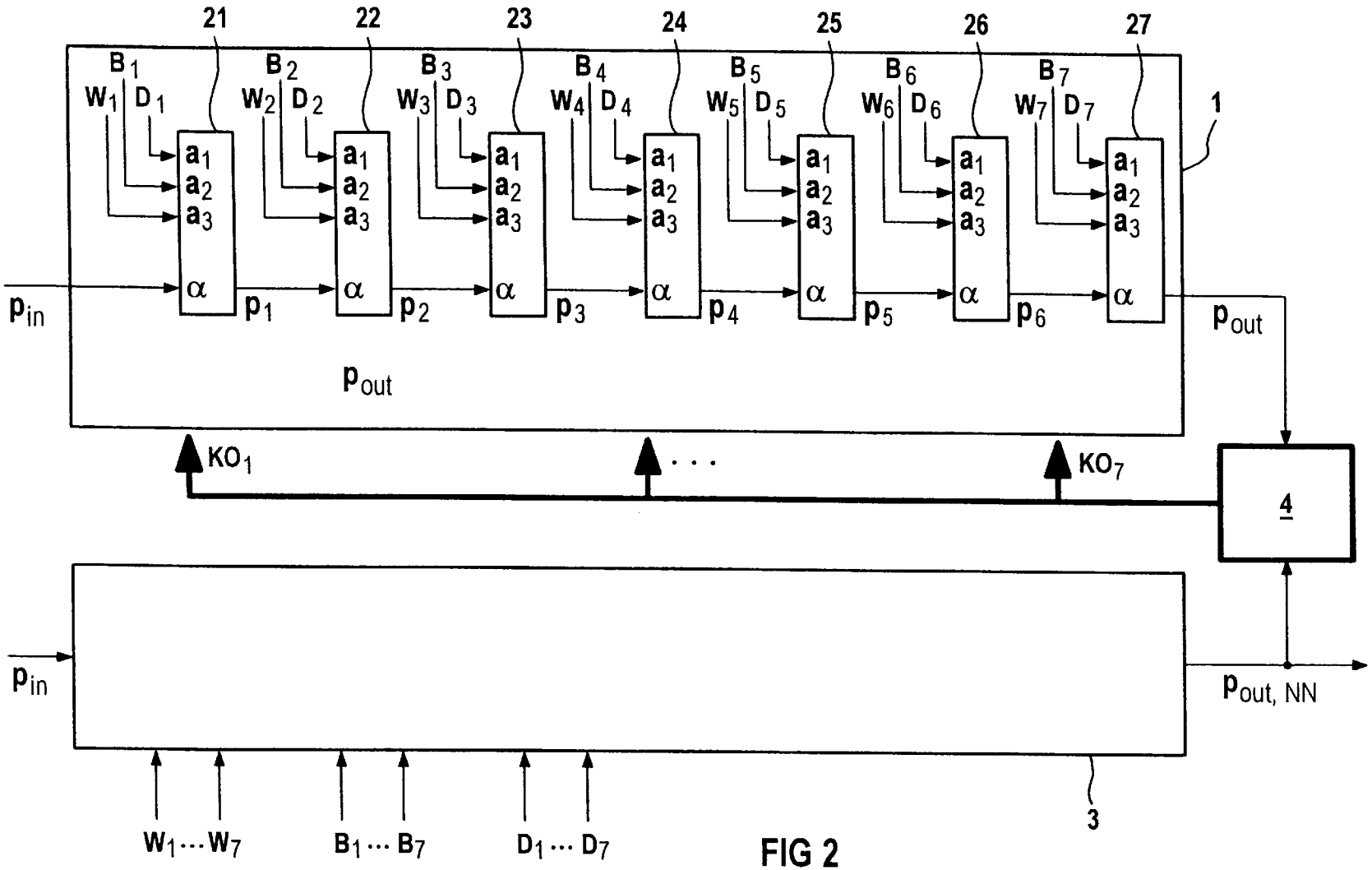
FIG. 2 shows a flow chart of the method according to the present invention.

FIG. 2 shows an example embodiment of the present invention.

Analytical model 1 has seven partial models 21, 22, 23, 24, 25, 26, 27, which model seven roll stands of a mill train. The input quantities for the first partial model are run-in profile $p_{in}$ of the metal strip and roll stand-specific data $W_1$, $B_1$, and $D_1$ for the first roll stand. The input quantities for the $i^{th}$ partial model are accordingly roll stand-specific data $W_i$, $B_i$, and $D_i$ for the $i^{th}$ roll stand and intermediate profile $P_{i-1}$ of the metal strip entering the respective roll stand. The $i^{th}$ partial model produces as an output quantity intermediary profile $p_1$ of the metal strip upon exiting from the respective roll stand; the last partial model produces a value for the final profile $p_{out}$. All roll stands are described by the same linear mapping. Discharge profile $p_i$ is represented as a linear combination of run-in profile $p_{i-1}$ and roll stand-specific parameters $W_i$, $B_i$, and $D_i$:

$$p_i = \alpha \cdot p_{i-1} + \alpha_1 \cdot W_i + \alpha_2 \cdot B_i + \alpha_3 \cdot D_i + \alpha_4 \tag{5}$$

where $\alpha$, $a_1$, $a_2$, $a_3$, and $a_4$ are model parameters of partial models 21, 22, 23, 24, 25, 26, 27.

For an arbitrary number of roll stand-specific parameters $P_k$ the following equation applies:

$$p_i = \alpha \cdot p_{i-1} + \sum_k a_k P_{k,i} \tag{6}$$

where $P_1$=D, $P_2$=B, and $P_3$=W.

Coefficients $\alpha$ and $a_k$ (where k=1, 2, 3, 4) are assumed to be identical for all roll stands; repeating this roll stand transfer function n times results in the transfer function for the profile over the entire mill train having n roll stands:

$$p_n = \alpha \cdot \left( \ldots \left( \alpha \cdot \left( \alpha \cdot p_0 + \sum_k a_k P_{k,1} \right) + \sum_k a_k P_{k,2} \right) + \ldots \right) + \sum a_k P_{k,n} \tag{7}$$

After transformation we have:

$$p_n = \alpha^n p_o + \sum_k \left( a_k \sum_{l-1}^{n} \alpha^{n-1} p_l \right) \tag{8}$$

This function remains linear in coefficients $a_k$. Coefficient $\alpha$, however, appears with different powers. It can be considered a factor indicating how strongly the influence of the roll stands located further ahead in the mill train on the final profile decreases.

Adapting this model to a data set means finding values for coefficients $\alpha$ and $a_k$ that minimize the error of the final profile. For a given $\alpha$ the optimum $a_k$ can be determined using a linear regression, for example, by means of pseudo-inverses. The optimum $\alpha$ is advantageously determined by approximation methods. Since it is the only free parameter and the interval where it may be located is limited, standard methods are used for minimizing such as Newton's method. Meaningful values for $\alpha$ are between 0 and 1.

Furthermore, a neural network 3 is provided as a final profile model. It produces output quantity $p_{out,NN}$ from input quantities $p_{in}$, $W_1$ through $W_7$, $B_1$ through $B_7$ and $D_1$ through $D_7$. In general, this value $p_{out,NN}$ represents the final profile which a metal strip would have after passing through the (in this exemplary embodiment, seven) roll stands having settings according to roll stand-specific parameters $W_i$, $B_i$, and $D_i$, and is better than value $p_{out}$. An analyzer 4 compares values $p_{out}$ and $p_{out,NN}$ and calculates, if the difference of the two values exceeds a predefinable limit value, correction factors $k\mathbf{0}_1$ through $k\mathbf{0}_7$, by which coefficients $a_k$ and $\alpha$ of the partial models are multiplied. These correction factors $k\mathbf{0}_i$ are calculated so as to approximate $p_{out}$ to $p_{out,NN}$. With coefficients $a_k$ and $\alpha$, modified by correction factors $k\mathbf{0}_i$, of partial models 21, 22, 23, 24, 25, 26, 27, a second calculation of $p_{out}$ is performed, whereupon the new value for $p_{out}$ is compared to $p_{out,NN}$ and new correction factors $k\mathbf{0}_i$ are calculated. This process is repeated until the difference between $p_{out}$ and $p_{out,NN}$ no longer exceeds a predefinable value.

The final values $p_i$ thus obtained for the intermediary profile and value $p_{out}$ for the final profile now form the prediction values for the profile of the metal strip to be rolled. If these prediction values do not correspond to the desired profile, roll stand-specific parameters $W_i$ and $B_i$ must be adapted and calculation must be restarted. The roll stand data are rolling force $W_i$ in the $i^{th}$ roll stand and bending force $B_i$ in the $i^{th}$ roll stand.

The rolling gap profile can also be used as part of the roll stand data.

What is claimed is:

1. A method for determining an intermediary profile of a metal strip between an upstream roll stand and a downstream roll stand in a mill train, the mill train including at least two roll stands, comprising:

determining the intermediary profile and a first final profile of the metal strip downstream from the downstream roll stand using an analytic model having parameters;

determining a second final profile using a final profile model; and modifying at least one of the parameters so that a difference between the first final profile determined using the analytic model and the second final profile determined using the final profile model is reduced.

2. The method according to claim 1, wherein the modifying step includes modifying the at least one parameter until the difference between the first final profile determined using the analytic model and the second final profile determined using the final profile model is reduced by less than a predefined value.

3. The method according to claim 1, wherein the modifying step includes modifying the at least one parameter until the difference between the first final profile determined using the analytic model and the second final profile determined using the final profile model is reduced to zero.

4. The method according to claim 1, wherein the step of determining the second final profile includes determining the second final profile using a neural network.

5. The method according to claim 4, further comprising: training the neural network online.

6. The method according to claim 1, wherein the intermediary profile is determined as a function of a profile of the metal strip on entering the upstream roll stand, and as a function of roll stand settings.

7. The method according to claim 1, wherein the analytic model is a linear model.

8. The method according to claim 1, further comprising:

determining the intermediary profile downstream from selected roll stands of the at least two roll stands of the mill train.

9. The method according to claim 1, further comprising:

determining the intermediary profile downstream from all roll stands of the mill train.

10. The method according to claim 1, wherein the analytic model has partial models which describe individual roll stands of the mill train.

11. The method according to claim 10, wherein each of the partial models have an identical structure.

12. The method according to claim 10, further comprising:

normalizing input quantities of the analytic model, the final profile model and the partial models.

13. A device for determining an intermediary profile of a metal strip between an upstream roll stand and a downstream roll stand in a mill train having at least two roll stands, comprising:

an analytic model having parameters, the analytic model to determine the intermediary profile and a first final profile of the metal strip downstream from the downstream roll stand;

a final profile model to determined a second final profile of the metal strip downstream from the downstream roll stand; and an analyzer to modify at least one of the parameters so that a difference between the first final profile determined using the analytic model and the second final profile determined using the final profile model is reduced.

* * * * *